US007382337B2

(12) United States Patent
Yoo

(10) Patent No.: US 7,382,337 B2
(45) Date of Patent: Jun. 3, 2008

(54) DISPLAY PANEL DRIVING METHOD

(75) Inventor: Hun-Suk Yoo, Cheonan-si (KR)

(73) Assignee: Samsung SDI Co., Ltd., Suwon-si, Gyeonngi-do (KR)

( * ) Notice: Subject to any disclaimer, the term of this patent is extended or adjusted under 35 U.S.C. 154(b) by 563 days.

(21) Appl. No.: 11/044,231

(22) Filed: Jan. 28, 2005

(65) Prior Publication Data

US 2005/0190120 A1 Sep. 1, 2005

(30) Foreign Application Priority Data

Feb. 26, 2004 (KR) ..... 10-2004-0013073

(51) Int. Cl.
*G09G 3/28* (2006.01)

(52) U.S. Cl. ..... 345/60; 345/66; 345/67

(58) Field of Classification Search ..... 345/60, 345/66–67

See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,876,343 | B2 * | 4/2005 | Myoung et al. | 345/67 |
| 6,906,690 | B2 * | 6/2005 | Lim | 345/60 |
| 7,151,510 | B2 * | 12/2006 | Whang et al. | 345/66 |

FOREIGN PATENT DOCUMENTS

| | | |
|---|---|---|
| JP | 02-148645 | 6/1990 |
| JP | 2001-043804 | 2/2001 |
| JP | 2001-325888 | 11/2001 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

*Primary Examiner*—Richard Hjerpe
*Assistant Examiner*—Leonid Shapiro
(74) *Attorney, Agent, or Firm*—Robert E. Bushnell, Esq.

(57) ABSTRACT

A method of driving a plasma display panel during an address period. In order to avoid address discharge failure at the temporal end of an address period, the voltages applied to the scanning electrodes and to the bias electrodes are decreased throughout the address period. By ramping these voltages down towards the end of the address period, mis addressing is less likely to occur. Other modifications to the driving waveforms include altering the amplitude and/or the temporal width of the address pulses and the scanning pulses. Such techniques allow the address period to remain short while preventing failure during the address period.

19 Claims, 10 Drawing Sheets

DISPLAY PANEL DRIVING METHOD

CLAIM OF PRIORITY

This application makes reference to, incorporates the same herein, and claims all benefits accruing under 35 U.S.C. §119 from an application for DISPLAY PANEL DRIVING METHOD earlier filed in the Korean Intellectual Property Office on 26 Feb. 2004 and there duly assigned Serial No. 2004-13073.

BACKGROUND OF THE INVENTION

1. Field of the Invention

The present invention relates to displays, and in particular to high definition plasma displays with many scanning lines, and in particular to modifying voltage waveforms applied to electrodes during an address period to prevent addressing failure.

2. Description of the Related Art

Plasma display panels (PDPs) offer a large screen to display an image thereon. In high definition (HD-PDPs), there is a large number of scanning lines in the display. However, a problem exists in that address discharge is more apt to fail in the addressing of the later lines of pixel selection. What is needed is a way to overcome the problem of increased risk of failure in addressing the higher number scan lines in a display with many scanning lines without lengthening the temporal size of the address period.

SUMMARY OF THE INVENTION

It is therefore an object of the present invention to provide a way to overcome the increased risk of address failure in a plasma display panel having many scanning lines.

It is also an object of the present invention to provide a method of overcoming the problem of address failure in selecting pixels in a PDP.

It is further an object of the present invention to provide improved electrical signals that can be applied to the electrodes of a PDP during the address period that will result in less failure.

It is still an object of the present invention to provide a display panel driving method for enhancing reliability of an address discharge.

These and other objects can be achieved by a display panel driving method using driving waveforms for first, second and address electrodes during the address period. The method involves applying sequentially scanning pulses to a plurality of first electrodes during the address period, applying a bias voltage to second electrodes, and applying address data to address electrodes, reducing an upper voltage of the scanning pulses over time while maintaining scanning pulse amplitude throughout the address period. A potential between the upper voltage and a lower voltage of scanning pulses applied to the first electrodes being constant while reducing the voltage to the first electrodes, and reducing a bias voltage applied to the second electrodes over time during a predetermined time in the address period.

A period during which the voltage of the scanning pulses is reduced coincides with a period during which the bias voltage is reduced. The bias voltage is reduced over a predetermined time in a period during which the upper voltage of the scanning pulses is reduced. A reduction rate that the bias voltage is reduced is identical to a reduction rate of the upper voltage of the scanning pulses.

The bias voltage may be reduced gradually and continuously. The bias voltage may instead be reduced step by step at discrete times. The upper voltage of the scanning pulses may be reduced gradually and continuously. The upper voltage of the scanning pulses may be reduced step by step at discrete times. During the address period, the upper voltage (the amplitude of the pulses) of a signal applied to the address electrodes may increase over time. During the address period, the widths of the scanning pulses and address pulses may increase over time.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
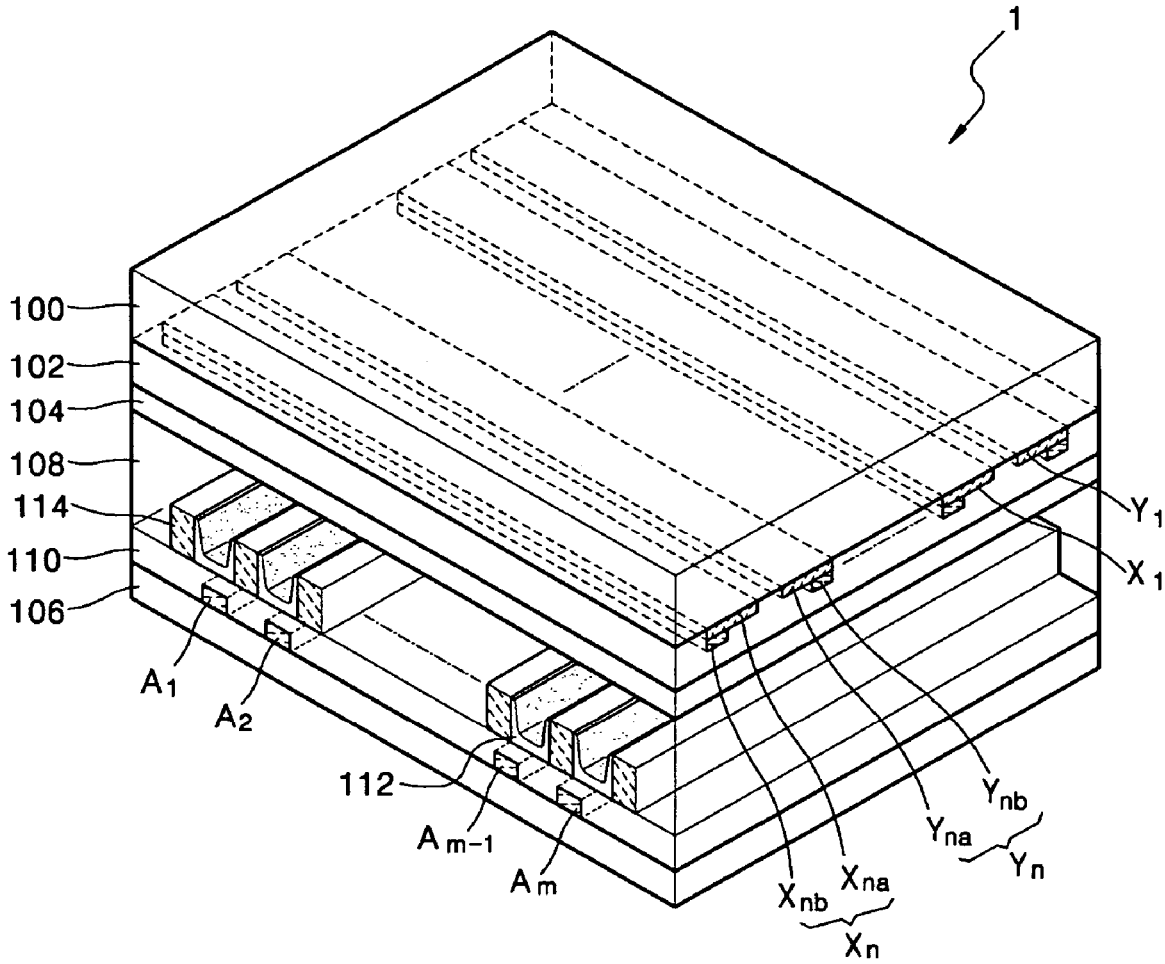
FIG. 1 is a perspective view of a plasma display panel with a 3-electrode surface discharge structure.

Turning now to the figures, FIG. 1 is a perspective view of a plasma display panel with a 3-electrode surface discharge structure. Referring to FIG. 1, the surface discharge plasma display panel 1 includes address electrode lines $A_1$, $A_2, \ldots, A_m$, dielectric layers 102 and 110, Y (or scanning) electrode lines $Y_1, \ldots, Y_n$, X (or bias) electrode lines $X_1, \ldots, X_n$, phosphors 112, partition walls 114, and an MgO layer 104, serving as a protection layer, formed between front and rear glass substrates 100 and 106.

The address electrode lines $A_1, A_2, \ldots, A_m$ are formed in a predetermined pattern on an upper surface of the rear glass substrate 106. The lower dielectric layer 110 is located on the address electrode lines $A_1, A_2, \ldots, A_m$. The partition walls 114 are formed on the lower dielectric layer 110 parallel to the address electrode lines $A_1, A_2, \ldots, A_m$. The partition walls 114 partition discharge areas of display cells and prevents cross-talk between the display cells. The phosphor layers 112 are formed between each pair of adjacent partition walls 114.

The X electrode lines $X_1, \ldots, X_n$ and Y electrode lines $Y_1, \ldots, Y_n$ constitute display electrode line pairs and are formed in a predetermined pattern on a lower surface of the front glass substrate 100 to intersect the address electrode lines $A_1, A_2, \ldots, A_m$. Each of the intersections forms a corresponding display cell. Each of the X-electrode lines $X_1, \ldots, X_n$ and the Y-electrode lines $Y_1, \ldots, Y_n$ is formed by coupling a transparent electrode line, e.g., $X_{na}$ or $Y_{na}$ composed of a transparent conductive material such as ITO (Indium Tin Oxide) with a metal electrode line $X_{nb}$ or $Y_{nb}$ for enhancing conductivity. The upper dielectric layer 102 is located on the X-electrode lines $X_1, \ldots, X_n$ and Y electrode lines $Y_1, \ldots, Y_n$. A protection layer 104, for example, an MgO layer, protecting the panel 1 in a strong electric field, is formed on the rear surface of the upper dielectric layer 102. A discharge space 108 is filled with plasma-forming gas and is sealed.

A method for driving a plasma display panel as described above includes sequentially an initializing step, an address step, and a display sustain step in sub-field units. In the initializing step, electric charges of the display cells are uniformly distributed. In the address step, the state of electric charges in display cells to be selected and the state of electric charges in display cells not to be selected are set. In the display sustain step, display discharges are generated in the display cells selected in the address step. In the display sustain step, plasma is generated by the plasma-forming gas in the display cells so that the display discharges occur causing the phosphors 112 of the display cells to be excited by ultraviolet radiation from the plasma, thus generating light.

Figure 2:
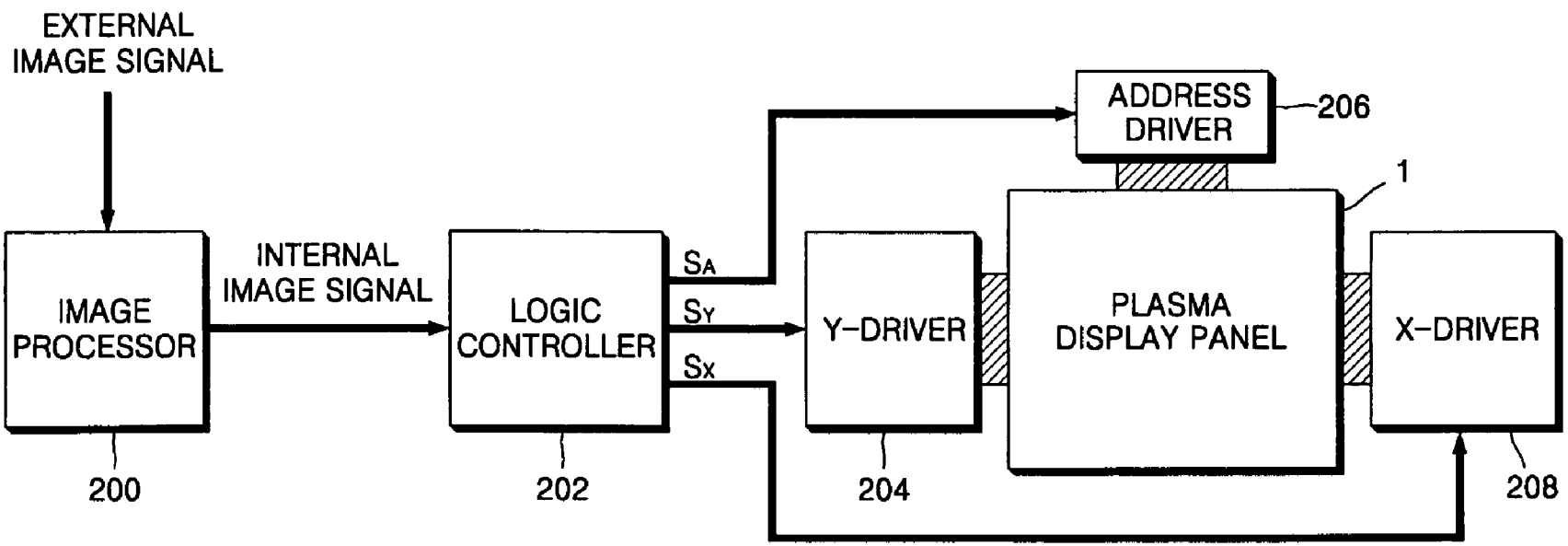
FIG. 2 is a block diagram of a driving apparatus for the plasma display panel illustrated in FIG. 1.

Turning now to FIG. 2, FIG. 2 is a block diagram of a driving apparatus of the plasma display panel illustrated in FIG. 1. Referring to FIG. 2, the driving apparatus for driving the plasma display panel 1 includes an image processor 200, a controller 202, an address driver 206, an X driver 208, and a Y driver 204. The image processor 200 converts external analog image signals into digital signals to generate internal image signals, for example, red (R), green (G), and blue (B) image data, each having 8 bits, clock signals, and vertical and horizontal synchronization signals. The controller 202 generates driving control signals $S_A$, $S_Y$, and $S_X$ according to the internal image signals output from the image processor 200. The address driver 206 processes an address signal $S_A$ among the driving control signals $S_A$, $S_Y$, and $S_X$ output from the controller 202, generates a display data signal, and applies the display data signal to the address electrode lines. The X driver 208 processes an X driving control signal $S_X$ among the driving control signals $S_A$, $S_Y$, and $S_X$ output from the controller 202 and applies the X driving control signal $S_X$ to the X electrode lines. The Y driver 204 processes a Y driving control signal $S_Y$ among the driving control signals $S_A$, $S_Y$, and $S_X$ output from the controller 202 and applies the Y driving control signal $S_Y$ to the Y electrode lines.

Figure 3:
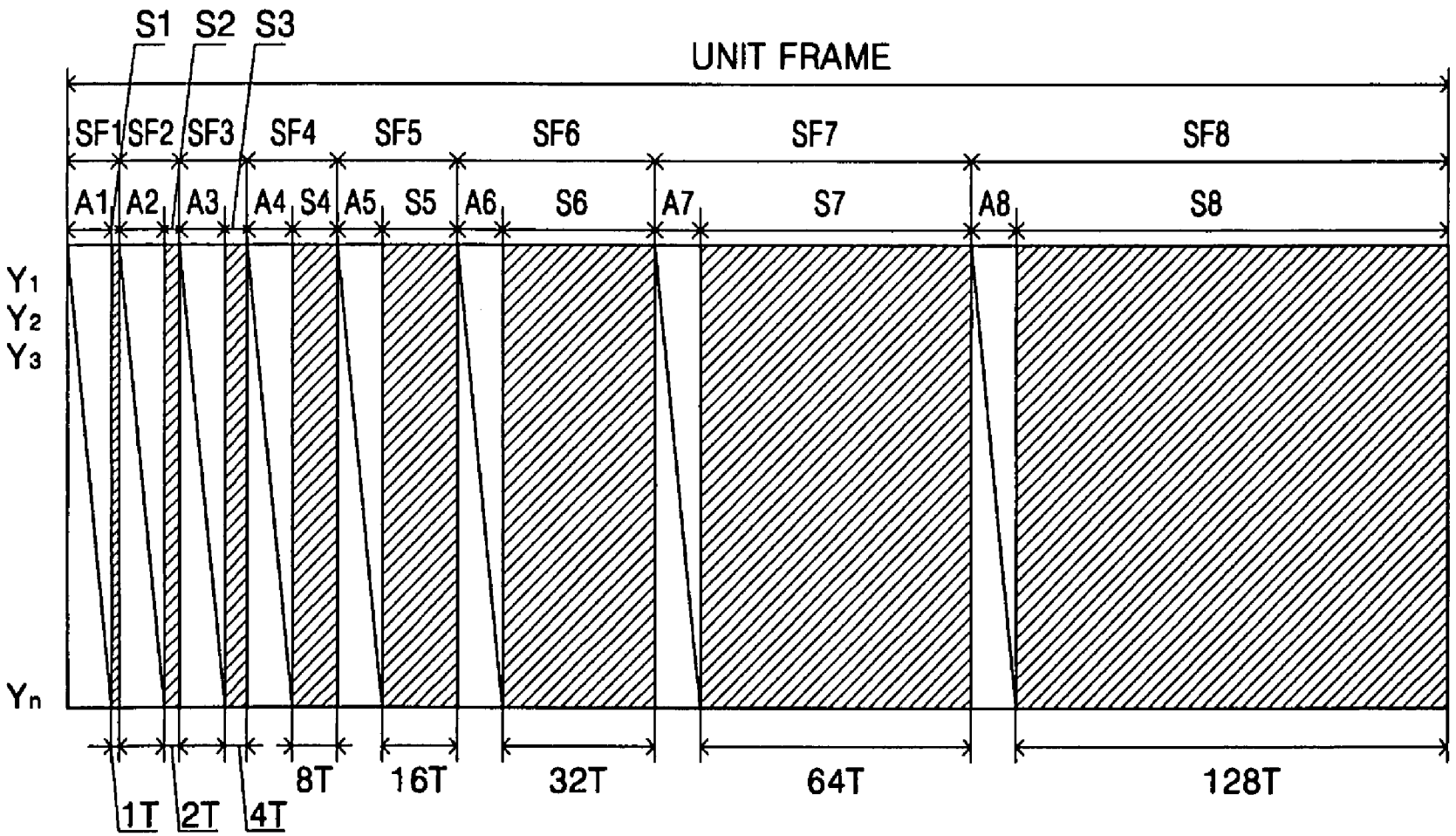
FIG. 3 is a timing diagram for explaining a Address-Display Separation driving method applied to Y electrode lines of the plasma display panel of FIG. 1.

An Address-Display Separation (ADS) driving method, which is an example of a method for driving the plasma display panel 1 described above, is disclosed in U.S. Pat. No. 5,541,618 to Shinoda. FIG. 3 is a timing diagram for explaining an Address-Display Separation driving method applied to the Y electrode lines of the plasma display panel of FIG. 1.

Referring to FIG. 3, a unit frame is partitioned into 8 sub-fields SF1, . . . , SF8 in order to implement time-division gradation display. The sub-fields SF1, . . . , SF8 are divided into resetting times (not illustrated), address times A1, . . . , A8, and discharge sustain periods S1, . . . , S8, respectively. During each of the address times A1, . . . , A8, display data signals are applied sequentially to the address electrode lines ($A_1, A_2, \ldots, A_m$ of FIG. 1) while corresponding injection pulses are applied sequentially to each of the Y electrode lines $Y_1, \ldots, Y_n$. During each of the display sustain times S1, . . . , S8, display sustain pulses are applied alternately to all the Y electrode lines $Y_1, \ldots, Y_n$ and then all the X electrode lines $X_1, \ldots, X_n$, so that display discharges are generated in discharge cells in which wall charges are formed during the corresponding address times A1, . . . , A8.

The brightness of a plasma display panel is proportional to the number of sustain discharge pulses produced during the display sustain times S1, . . . , S8 in a unit frame. If a frame forming an image is represented by 8 sub-fields and 256 gradations, 1, 2, 4, 8, 16, 32, 64, and 128 sustain pulses can be allocated to the respective sub-fields SF1 through SF8, respectively. Therefore, for example, to obtain a brightness of 133 gradations, cells should be addressed and sustain-discharged during sub-fields SF1, SF3, and SF8 (see FIG. 3).

The number of sustain-discharge pulses allocated to each sub-field can be variably set according to the weights of sub-fields on the basis of Automatic Power Control (APC). Also, the number of the sustain-discharge pulses allocated to the respective sub-fields can be changed according to gamma characteristics or panel characteristics. For example, the gradation 8 allocated to the sub-field SF4 can be decreased to 6 and the gradation 32 allocated to the sub-field SF6 can be increased to 34. Further, the number of sub-fields forming a frame can be changed according to a design rule.

Figure 4:
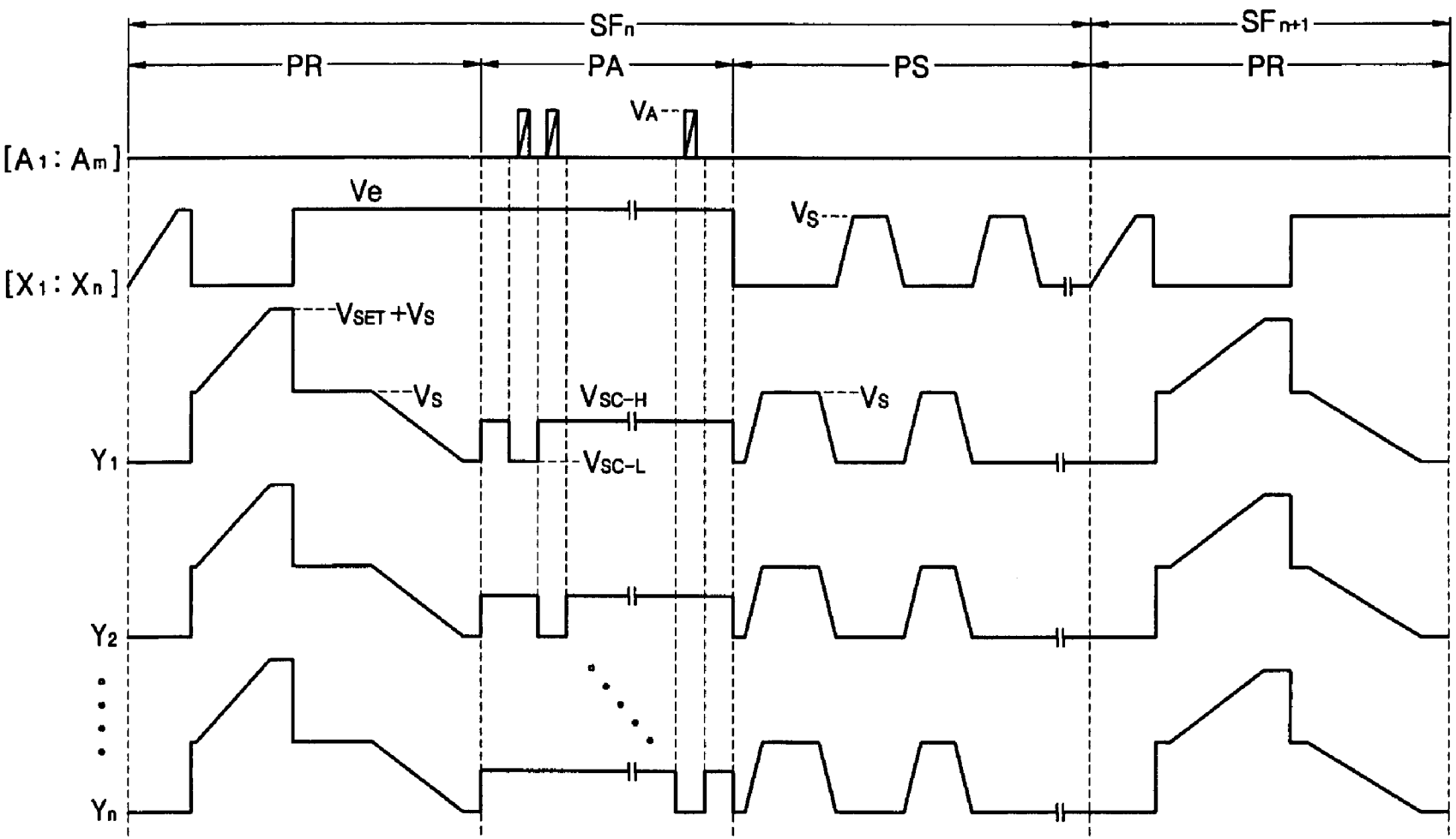
FIG. 4 is a timing diagram for explaining an exemplary driving signal for driving the plasma display panel of FIG. 1.

Turning now to FIG. 4, FIG. 4 is a timing diagram for explaining an exemplary driving signal for driving the plasma display panel of FIG. 1. The driving signal is applied to the address electrodes $A_1$ through $A_m$, the common electrodes $X_1$ through $X_n$, and the scanning electrodes $Y_1, \ldots, Y_n$ during a sub-field SF according to the ADS driving method for an AC PDP. Referring to FIG. 4, each sub-field SF includes a reset period PR, an address period PA, and a sustain-discharge period PS.

During the reset period PR, reset pulses are applied to all scanning electrode line groups as to unconditionally perform write discharges, thus uniformly distributing wall charges in all display cells. Since the reset period PR is performed throughout the entire panel before the address period PA, the wall charges can be distributed uniformly. Accordingly, cells initialized during the reset period PR have a similar wall charge distribution.

The address period PA occurs after the reset period PR. During the address period PA, a bias voltage Ve is applied to the common (or bias) electrodes X to simultaneously turn on one of the scanning electrodes $Y_1, \ldots, Y_n$ and one of the address electrodes $A_1, \ldots, A_m$ at the location of a display cell to produce light, thus selecting a display cell. After the address period PA, sustain pulses Vs are applied alternately to the common electrodes X and then all the scanning electrodes $Y_1, \ldots, Y_n$, so that the sustain-discharge period PS is performed. During the sustain-discharge period PS, a low voltage VG is applied to the address electrodes $A_1, \ldots, A_m$.

The brightness of a PDP is controlled by the number of sustain-discharge pulses produced. As the number of sustain-discharge pulses produced during a sub-field or a TV field increases, the brightness increases.

In a PDP, the time used for addressing is very important for increasing the number of sub-fields or achieving a high resolution. Accordingly, to enhance the brightness and display various gradations, it is necessary to increase the time allocated for sustain discharge. However, in a PDP, since a period of a TV field is fixed, for example, at 60 Hz, or 16.67 ms, shortening an address period is required to increase a corresponding sustain discharge period.

However, as an address period becomes shorter, the reliability of address discharge deteriorates. Also, since a failure of address discharge results in a failure of sustain discharge, increasing a probability of success of address discharge is very important in achieving high resolution. If it is assumed that a lower voltage (or trough) of scanning pulses applied to scanning electrodes is $V_{sc-L}$ and an upper voltage (or peak) of address data applied to address electrodes is $V_a$, address discharge is generated due to a voltage difference (or amplitude of the pulse, $V_a-V_{sc-L}$) between the voltages $V_{sc-L}$ and $V_a$.

However, plasma priming for address discharge occurring during the reset period PR is reduced with the elapse of time. Accordingly, during the latter portion of the address period PA, in the edge portions of the display panel, a probability of failure of addressing increases and a probability of low discharge also increases. This is because there is a longer gap in time between the end of the reset period and the addressing of the edge portion of the display.

If it is assumed that the widths of scanning pulses applied to a scanning line during the address period are 1.2-1.5 μs and a HD plasma display panel with 768 scanning lines is used, address discharge of a 700th scanning line $Y_{700}$ is generated 840-1050 μs after address discharge of a first scanning line $Y_1$. Accordingly, the 700th scanning line $Y_{700}$ has a higher failure probability for address discharge due to the loss of spatial charges within discharge spaces of the scanning electrodes and the address electrodes than the first scanning line $Y_1$.

In an effort to remedy this problem, increasing the widths of the scanning pulses to prevent such address discharge failure results in a reduction of the corresponding sustain discharge period PS. Thus, what is needed is some other solution to prevent the high failure rate of addressing scanning lines at the end of the address period.

Figure 5A:
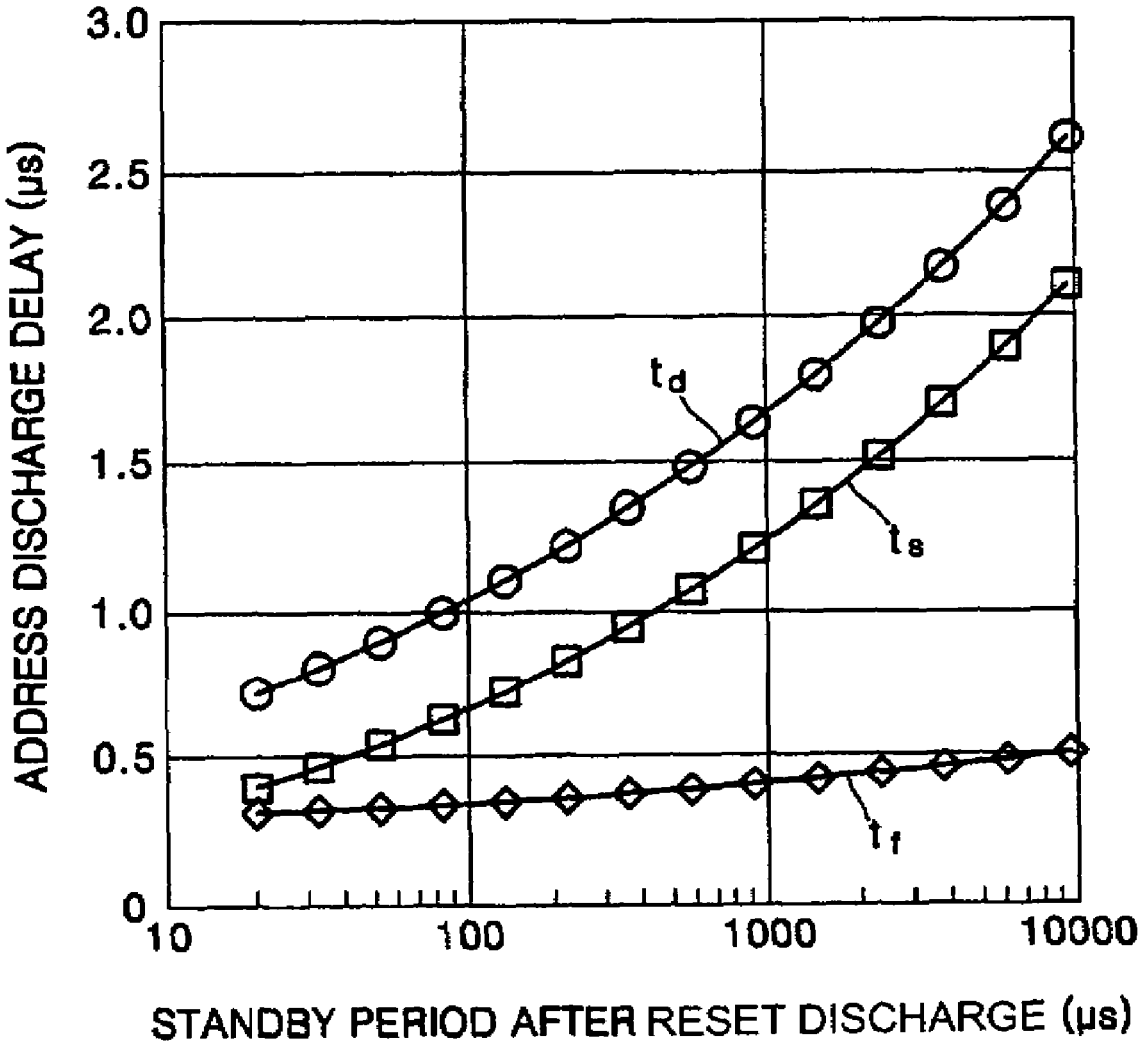
FIGS. 5A and 5B are graphs for explaining an example of an address discharge delay time $t_d$.
Figure 5B:
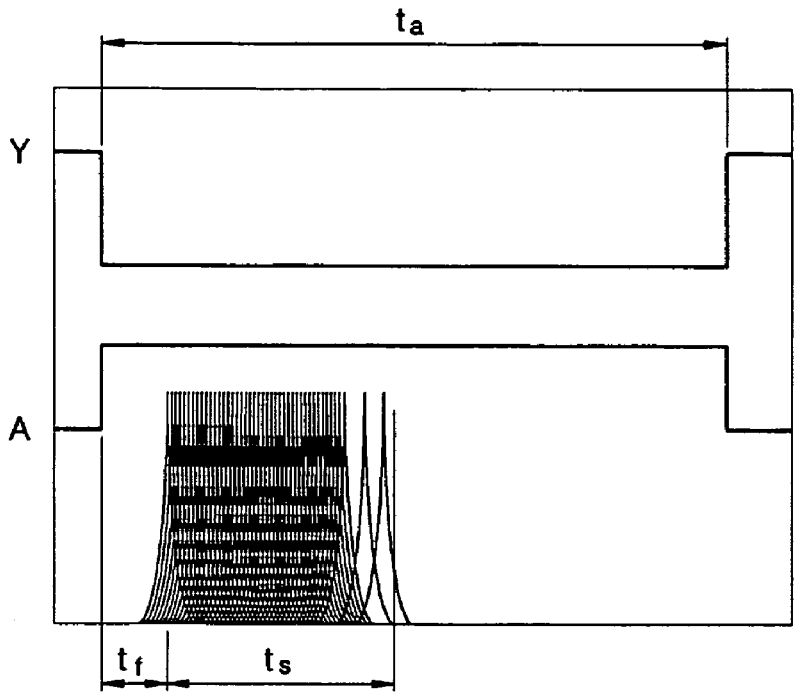

A display panel driving method according to the present invention is provided to compensate for the reduction of priming particles in plasma by modifying scanning pulses while preventing a faulty discharge between scanning electrodes Y and bias electrodes X during an address period. Turning to FIGS. 5A and 5B, FIGS. 5A and 5B are graphs for explaining an address discharge delay time $t_d$. The address discharge delay time $t_d$ is the sum of a discharge formation delay time $t_f$ and a statistical discharge delay time $t_s$. That is, $t_d=t_s+t_f$. Referring to FIG. 5A, $t_f$ and $t_s$ increase over time. In particular, a rate of increase of $t_s$ after reset discharge is much greater than that of $t_f$. Since $t_a$, the width of a scanning pulse in the address period must be greater than $t_d$ in order to avoid address failure, it can be seen from FIG. 5A that pulses long after the expiry of the reset period are more apt to fail than scanning pulses that occur just after the end of the reset period.

Turning now to FIG. 5B, FIG. 5B illustrates a measurement of a radiation pattern of a display cell. Referring to FIG. 5B, the radiation pattern appears a time $t_f+t_s$ after scanning pulses Y and address data A are supplied.

During an address period, if a scanning pulse width is $t_a$, an address period is the product of $t_a$ and the number of scanning lines. Here, $t_a$ must be greater than the delay time $t_d$ as described above so that address discharge can be generated without an error. Referring to FIG. 5A, when a standby period after reset discharge is 100 μs, an address discharge delay time $t_d$ slightly longer than 1 μs is generated. This means that a scanning pulse width of 1 μs generates an address discharge error. If 1000 μs have elapsed, the address discharge delay time $t_d$ exceeds 1.7 μs. To perform stable address discharge, the scanning pulse width $t_a$ must be greater than 1.7 μs in order not to fail. Although there is no upper limit, since it is necessary to reduce a corresponding sustain discharge period in response to an increase of an address period, stablizing address discharge through increasing the scanning pulse width is limited.

If the widths of scanning pulses applied to a scanning line are 1.2-1.5 μs and an HD plasma display panel with 768 scanning lines is used, address discharge is generated on a 700th scanning line 840-1050 μs after address discharge is performed on a first scanning line $Y_1$. Accordingly, a failure probability of address discharge sharply increases for the final scanning lines due to the loss of space charges within the intersecting discharge spaces of the scanning electrodes and address electrodes.

HD-level PDPs include more scanning lines than other types of PDPs. Since a standby period after reset discharge is largest for the final scanning lines in an address period, a failure probability of address discharge also increases for the final scanning lines.

During addressing, priming particles are diffused inside cells, coupled to each other, and gradually disappear after a predetermined time elapses, when no external field exists. Accordingly, the density of priming particles generated by reset discharge decreases over time. In particular, $t_s$ greatly depends on the priming particles. Priming particles are made of space charges and excited neutrons. The density of the space charges sharply decrease by diffusing or drifting in 10-20 μs after discharging, resulting in the space charges disappearing. It is known that neutrons have longer lifetimes (about 300-400 μs) than space charges. It is also known that neutrons emit electrons as a result of deexcitation due to collision and $t_f$ and $t_s$ decrease when the density of the emitted electrons is maintained at a predetermined level.

As described above, since HD-level PDPs include more scanning lines than other types of PDPs, the discharge delay time reduction effect due to priming particles generated by reset discharge is worst for final scanning lines during an address period.

In detail, wall charge writing is performed for each scanning line through addressing. Since a time after reset discharge is changed according to an arrangement of the scanning lines and, accordingly, the number of priming particles facilitating addressing is changed, the address discharge delay time is changed. Accordingly, as the final scanning line is approached during the address period, a failure generation probability of address discharge increases.

A basic concept of the present invention is that a stable addressing operation can be performed by compensating for the loss of space charges due to the elapse of time after reset discharge by adjusting the waveform of scanning pulses in the address period while also adjusting the waveform applied to the bias electrode. The waveform applied to the bias electrode needs to also be adjusted to prevent faulty discharge between the bias electrodes and the scanning electrodes due to the change of the scanning pulse waveform. Here, the bias electrodes are the common electrodes X of FIG. 1 and the scanning pulses are applied to the Y electrodes of FIG. 1.

Figure 6:
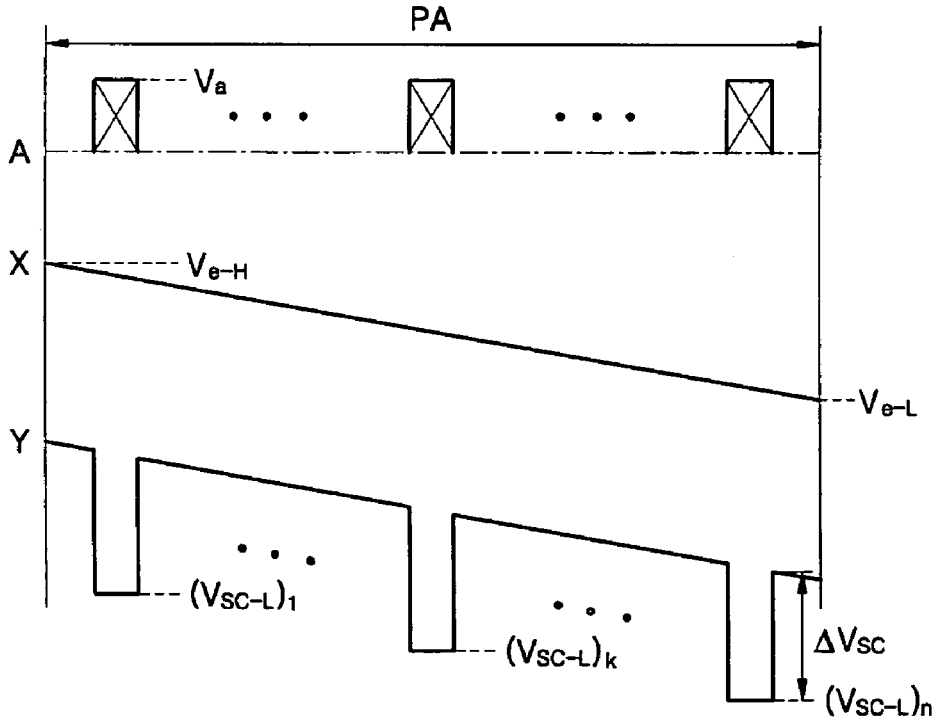
FIG. 6 illustrates waveforms applied to electrodes during an address period PA for explaining a panel driving method according to a first embodiment of the present invention.

FIG. 6 illustrates a waveform of voltages applied to the address, the bias and the scanning electrodes during the address period PA according to a first embodiment of the present invention. In FIG. 6, the scanning electrode waveform Y is illustrated as a single waveform, however in reality, Y is actually n separate waveforms ($Y_1$:$Y_n$) from n scanning electrodes superimposed onto each other with each scanning pulse corresponding to a different scanning electrodes and n being the number of scanning pulses.

With reference to the address period PA of FIG. 6, an upper (or peak) voltage of address data applied to address electrodes $A_1$ through $A_m$ is fixed at Va, a voltage applied to the bias electrodes X decreases from $V_{e-H}$ to $V_{e-L}$, and an upper (or peak) scanning voltage of scanning pulses applied to the scanning electrodes Y continuously decreases while maintaining a fixed pulse amplitude $\Delta V_{sc}$ between the upper scanning voltage and a lower scanning voltage (i.e., between peak and trough). Discharge cells of corresponding scanning electrodes are addressed using the potential difference between the upper voltage Va of the address electrodes A and the lower scanning voltage (or trough voltage) $V_{sc-L}$ of the scanning electrode Y. Accordingly, by increasing the voltage difference between the upper voltage Va applied to the address electrode A and the voltage applied to the scanning electrode Y, the temporal reduction of the density of priming particles created by reset discharge can be compensated for.

Turning now to Table 1 below, Table 1 illustrates empirical results of address discharge failure probabilities for the case where the upper or peak voltage $V_{sc-H}$ of scanning pulses is fixed and for the cases where the upper voltage $V_{sc-H}$ is varied throughout the address period in an HD-level PDP having 768 scanning lines.

TABLE 1

| $V_{sc-H}$ | +20 V (fixed) | +20 V -> -30 V (changed) | -20 V -> -50 V (changed) |
|---|---|---|---|
| First scanning line ($Y_1$) | 0.00% | 0.00% | 0.00% |
| 300-th scanning line ($Y_{300}$) | 0.05% | 0.02% | 0.00% |
| 400-th scanning line ($Y_{400}$) | 0.1% | 0.04% | 0.01% |
| 700-th scanning line ($Y_{700}$) | 3~5% | 0.06% | 0.02% |

The percentage values illustrated in Table 1 are address discharge failure probabilities. As can be gleaned from Table 1, the address discharge failure probability significantly decreases near the edges of the PDP where the reduction rate of the upper voltage $V_{sc-H}$ of the scanning pulses increases, as is represented by the right-most column in Table 1.

However, reducing the upper voltage $V_{sc-H}$ causes faulty discharge between the scanning electrodes Y and the bias electrodes X. The present invention also recognizes this problem and thus also reduces the voltage applied to the bias X electrodes during the course of the address period so that the potential difference between the scanning Y electrodes and the bias X electrodes does not become too large.

In the present invention, a voltage applied to the bias electrodes X is also reduced from $V_{e-H}$ to $V_{e-L}$ during the address period, so that the faulty discharge between the bias electrodes X and the scanning electrodes Y, which may result from overly reducing the lower voltage of the scanning pulses applied to the scanning electrodes Y, can be avoided. Here, the reduction rate of the bias voltage and the reduction rate of the scanning voltage may be the same or may be different from each other, depending to the characteristics of a PDP.

Figure 7:
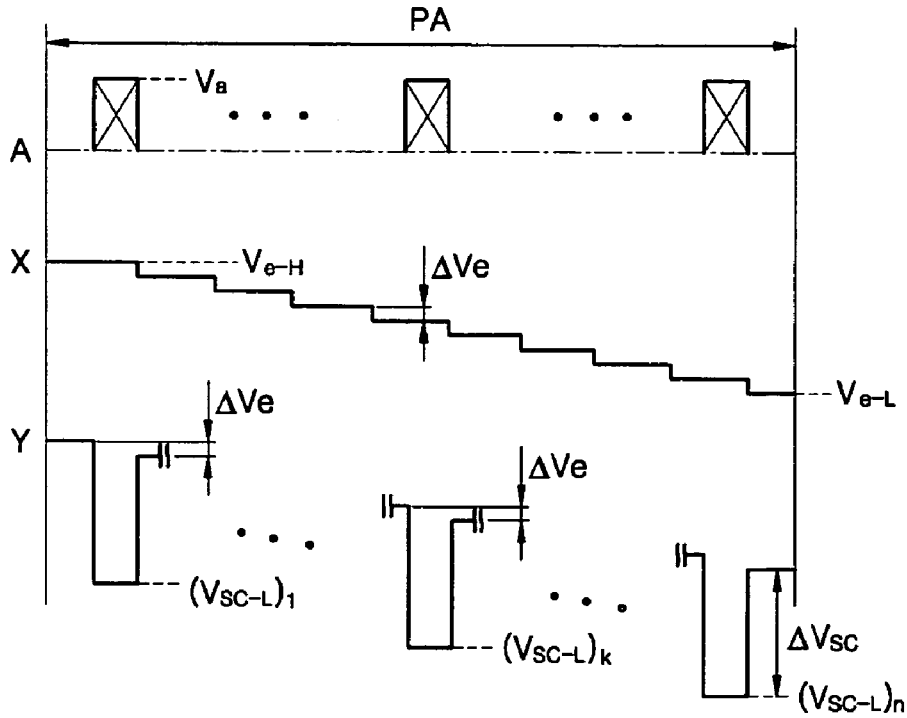
FIG. 7 illustrates waveforms applied to electrodes during an address period PA for explaining a panel driving method according to a modification of the first embodiment illustrated in FIG. 6.

Turning to FIG. 7, FIG. 7 illustrates waveforms applied to electrodes of a PDP during an address period PA according to a modification of the first embodiment illustrated in FIG. 6. In FIG. 7, a bias voltage applied to the bias X electrodes and an upper voltage of scanning pulses applied to the scanning Y electrodes are reduced at discrete points in time in steps as opposed to reducing gradually and continuously as in FIG. 6. FIG. 7 illustrates a case where the bias voltage and the scanning voltage are reduced in steps of ΔVe for each successive scanning line. However, the bias voltage and the scanning voltage can be reduced in steps for two or more scanning lines and the reduction rate can also be changed. Also, the stepwise reductions of the bias voltage and the scanning voltage can be different according to the characteristic of the display panel.

Figure 8:
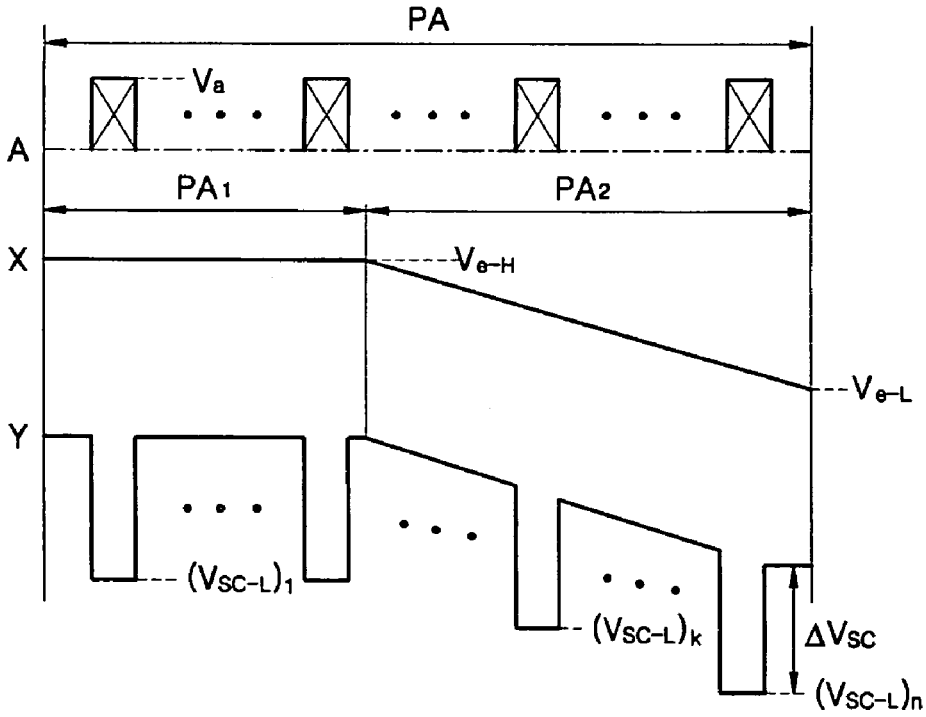
FIG. 8 illustrates waveforms applied to electrodes during an address period PA for explaining a panel driving method according to a second embodiment of the present invention.

Turning now to FIG. 8, FIG. 8 illustrates a waveforms applied to the A, X and Y electrodes of a display during an address period PA according to a second embodiment of the present invention. In the embodiment illustrated in FIG. 8, both a bias voltage applied to the X electrodes and a scanning voltage applied to the Y electrodes are maintained constant during an initial predetermined interval PA1 of the address period PA. The bias and the scanning voltages are then reduced during a following predetermined interval PA2. In FIG. 8, the length of the initial interval PA1 for which the bias voltage and the scanning voltage are maintained constant can be appropriately set according to the characteristics of the PDP, considering discharge deterioration due to the reduction of priming particles of plasma.

Referring to FIG. 8, both the bias voltage and the scanning voltage are maintained constant in the initial predetermined period PA1. However, the time where the scanning voltage starts to decrease can be made to occur at a different time than when the bias voltage starts to decrease.

Figure 9:
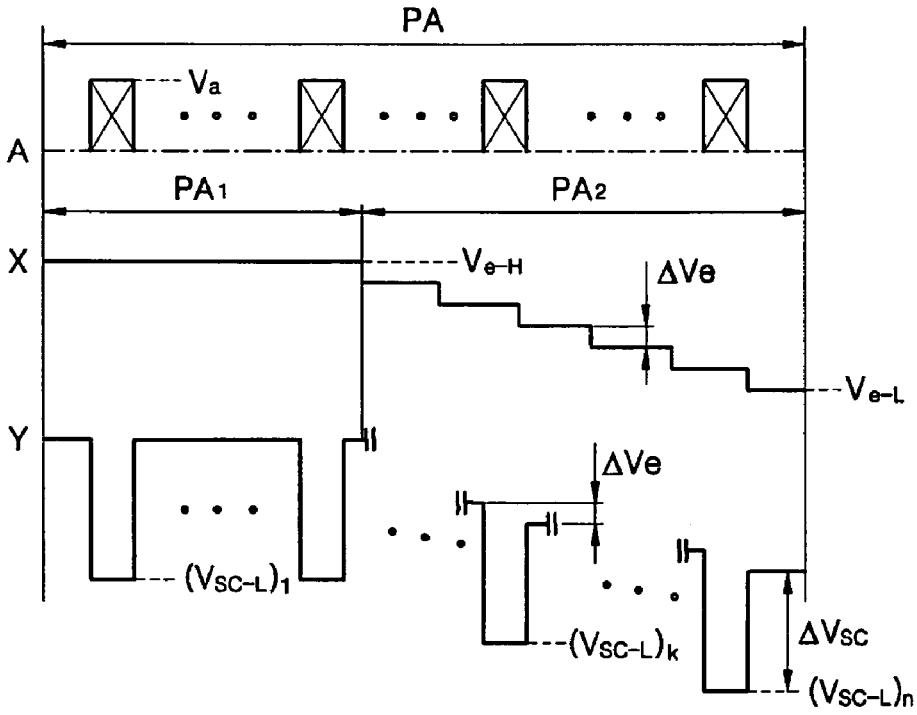
FIG. 9 illustrates waveforms applied to electrodes during an address period PA for explaining a panel driving method according to a modification of the second embodiment illustrated in FIG. 8.

Turning now to FIG. 9, FIG. 9 illustrates a waveform of an address period PA for explaining a panel driving method according to a modification of the second embodiment illustrated in FIG. 8. In the embodiment illustrated in FIG. 9, the bias voltage and the scanning voltage are maintained constant during the initial predetermined interval PA1 of the address period PA as in FIG. 8, but the bias voltage and the scanning voltage are reduced in steps during the following predetermined interval PA2.

Figure 10:
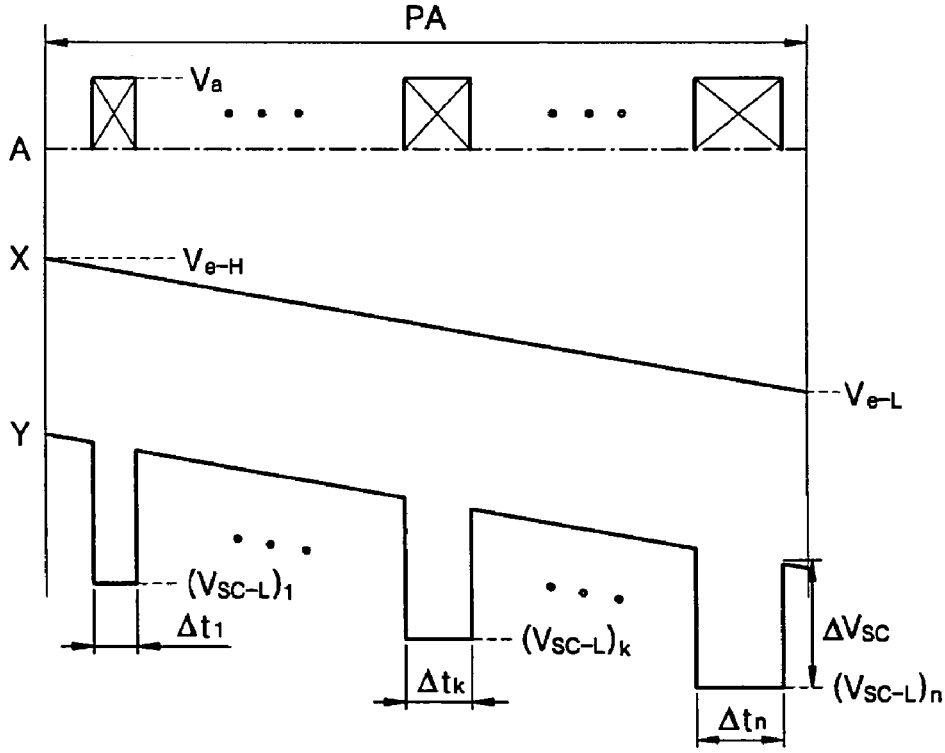
FIG. 10 illustrates waveforms applied to electrodes during an address period PA for explaining a panel driving method according to a third embodiment of the present invention.

Turning now to FIG. 10, FIG. 10 illustrates a waveforms applied to the A, X and Y sets of electrodes during an address period PA for explaining a panel driving method according to a third embodiment of the present invention. In FIG. 10, the widths of scanning pulses and the widths of the address pulses increase over time. In FIG. 10, the widths of the scanning pulses and address pulses increase gradually over Δt1, . . . , Δtk, . . . , Δtn. However, it is also possible to divide the address period PA into a predetermined number of periods and change the scanning pulse widths such that a same scanning pulse width is applied throughout the period. As such, by increasing the widths of scanning pulses with the elapse of time in an address period, it is possible to compensate for an address discharge delay time due to the reduction of priming particles of plasma.

Figure 11:
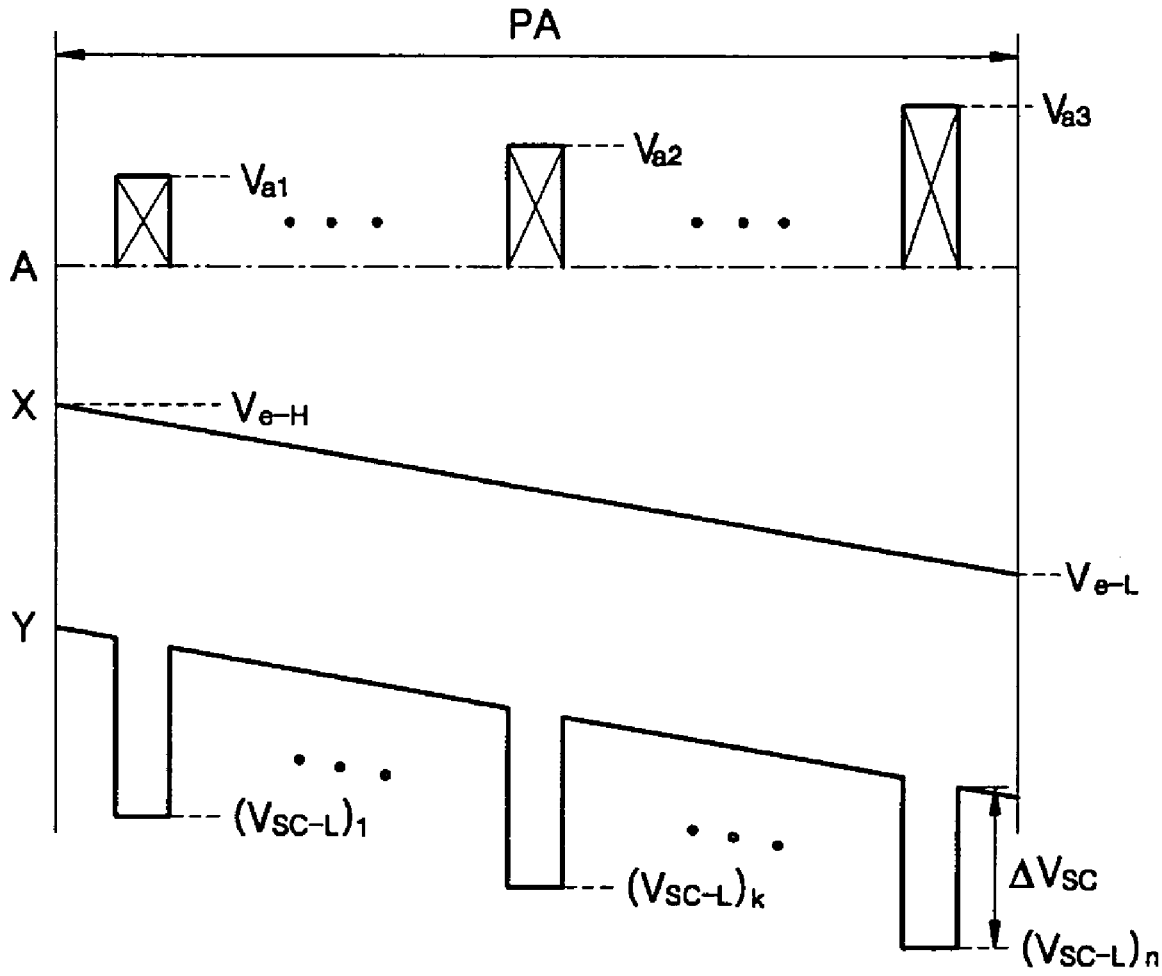
FIG. 11 illustrates waveforms applied to electrodes during an address period PA for explaining a panel driving method according to a fourth embodiment of the present invention.

Turning now to FIG. 1, FIG. 11 illustrates a waveforms applied to the A, X and Y electrode sets of a PDP during an address period PA according to a fourth embodiment of the present invention. In FIG. 1, an upper voltage (peak voltage) and the amplitude of address data applied to address electrodes A increases from $V_{a1}$ to $V_{a3}$ via $V_{a2}$ (from initial addressing to final addressing) and an upper voltage (peak voltage) of scanning pulses applied to scanning electrodes Y is continuously reduced with the potential difference between peak and trough (i.e., the amplitude of the pulses) being constant at $\Delta V_{sc}$.

In the embodiment illustrated in FIG. 11, the temporal reduction of the density of priming particles created by reset discharge in the address period is compensated for by reducing the upper voltage $V_{sc\text{-}H}$ and the lower voltage $V_{sc\text{-}L}$ of the scanning pulses applied to the Y electrodes while increasing the upper voltage $V_a$ of the address data. Further, faulty discharge, which may occur between the scanning electrodes Y and the bias electrodes X upon addressing, is prevented by also reducing the voltage applied to the bias electrodes X from $V_{e\text{-}H}$ to $V_{e\text{-}L}$. In FIG. 11, three upper voltages $V_{a1}$, $V_{a2}$, and $V_{a3}$ of address data are illustrated, however, more levels can be provided and the voltages can increase gradually for each subsequent scanning line.

Turning now to Table 2 below, Table 2 illustrates a combination of embodiments in which an upper voltage Va of address data, a scanning pulse width Δt, a bias voltage $V_e$ and an upper voltage $V_{sc\text{-}H}$ of a scanning pulse are changed gradually in order to perform a stable addressing operation in a HD-level plasma display panel having 768 scanning lines. In detail, the present invention can be embodied by (1) increasing an upper voltage Va of address data, by (2) increasing a scanning pulse width Δt, by (3) reducing both a bias voltage $V_e$ and an upper voltage $V_{sc\text{-}H}$ of a scanning pulse, or by performing a combination of two or more of any of action (1), (2) and (3). The upper voltage $V_{sc\text{-}H}$ of a scanning pulse may be from 20V to −30V or from 20V to −50V.

TABLE 2

| Items | First line | . . . | 384th line | . . . | 768th line |
|---|---|---|---|---|---|
| $V_a$ | 60 V | . . . | 70 V | . . . | 80 V |
| Δt | 1.2 μs | . . . | 1.81 μs | . . . | 2.4 μs |
| $V_e$ | 160 V | . . . | 130 V | . . . | 100 V |
| $V_{sc\text{-}H}$ | +20 V | . . . | −5 V | . . . | −30 V |
| $V_{sc\text{-}H}$ | +20 V | . . . | −15 V | . . . | −50 V |

Figure 12:
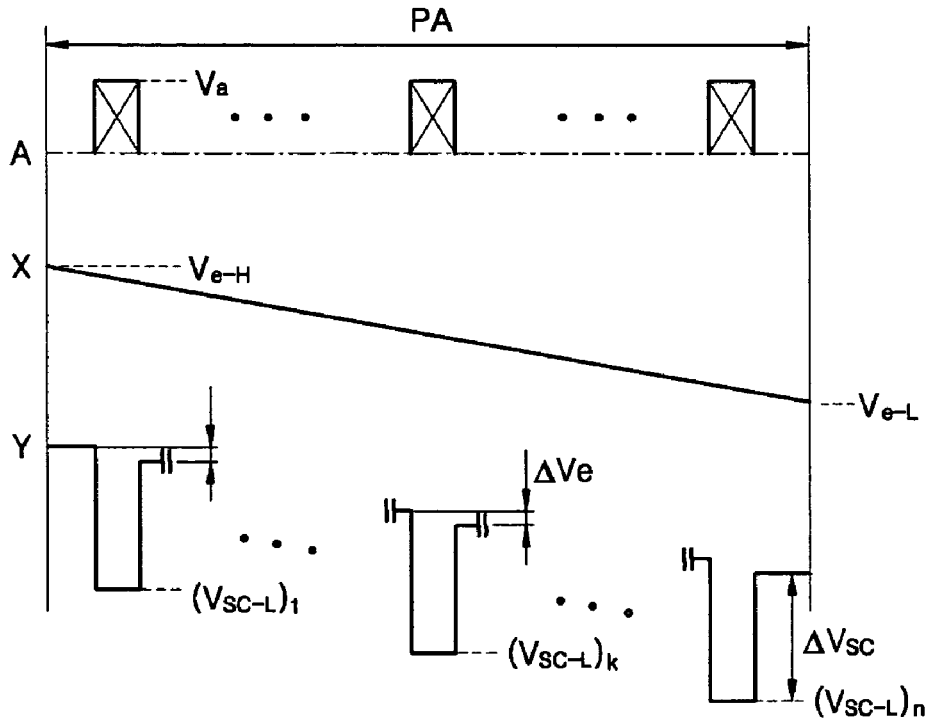
FIG. 12 illustrates waveforms applied to electrodes during an address period PA for explaining a panel driving method according to a fifth embodiment of the present invention.

Turning now to FIG. 12, FIG. 12 illustrates a waveforms applied to electrodes during an address period PA according to a fifth embodiment of the present invention. During the address period PA of the embodiment illustrated in FIG. 12, the upper voltage $V_a$ of address data applied to the address electrodes A is maintained constant while the voltage of the scanning pulses applied to the scanning electrodes Y is reduced in steps for each scanning line and the bias voltage applied to the bias electrodes X is reduced gradually or continuously from $V_{e\text{-}H}$ to $V_{e\text{-}L}$.

Figure 13:
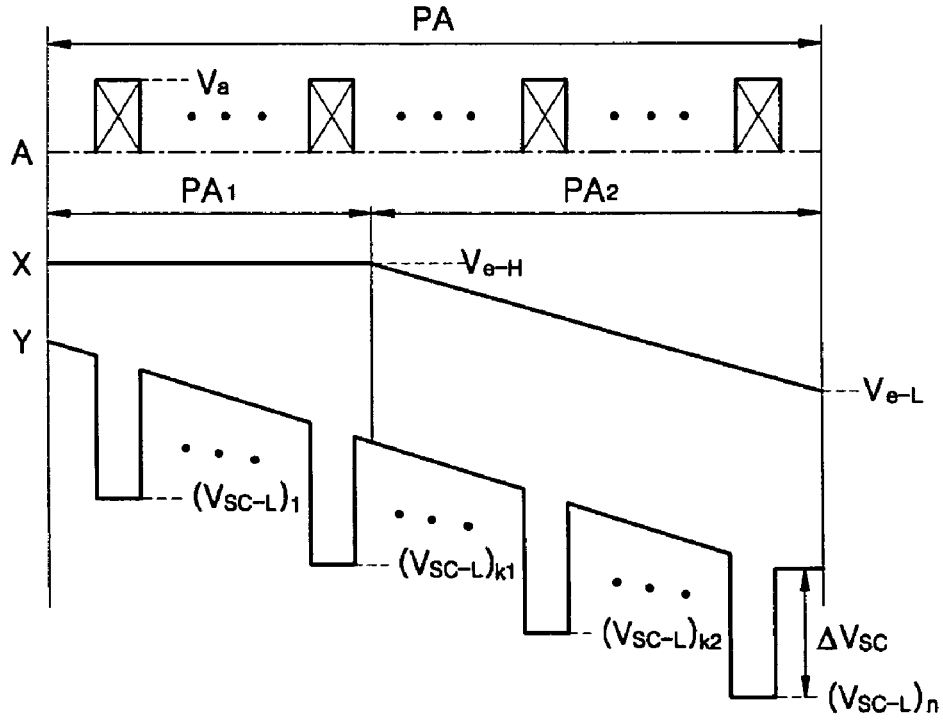
FIG. 13 illustrates waveforms applied to electrodes during an address period PA for explaining a panel driving method according to a sixth embodiment of the present invention.

Turning now to FIG. 13, FIG. 13 illustrates a waveforms applied to electrodes of a PDP according to a sixth embodiment of the present invention. In the embodiment illustrated in FIG. 13, the bias voltage that is applied to the X electrodes and the scanning voltage applied to the Y electrodes are gradually reduced only during a predetermined period PA2 after remaining constant during period PA1. Faulty discharge between scanning electrodes Y and bias electrodes X occurs when a voltage difference between the bias voltage and the lower voltage of the scanning pulses in the scanning electrodes is greater than a predetermined value. It is also possible to adjust the length of period PA2 according to the characteristics of a PDP.

The display driving method of the present invention can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves. The computer readable recording medium can also be distributed over network coupled computer systems so that the computer readable code is stored and executed in a distributed fashion.

In particular, the panel driving method according to the present invention can be implemented by a programmable integrated circuit, for example, FPGA (Field Programmable Gate Array), which is made by a schematic or VHDL on a computer and connected to a computer. The recording medium includes such a programmable integrated circuit.

The display panel driving method according to the present invention can be applied to all plasma display apparatuses which use an address period in advance of selecting cells to be turned on and then perform a sustain period producing light in the selected cell. The display panel driving method according to the present invention can be applied to display panels in which addressing operations are performed for two or more sequential scanning lines after a period for obtaining optimal conditions for addressing, for example, a reset period.

As described above, in the display panel driving method according to the present invention, a bias voltage is reduced while an upper voltage of scanning pulses is also reduced over time during an address period. Accordingly, it is possible to prevent faulty discharge, which may occur between scanning electrodes and bias electrodes, while compensating for priming plasma in the latter portion of an address period.

Accordingly, by freely changing the upper voltage of the scanning pulses without generating faulty discharge between the scanning electrodes and bias electrodes during the address period, it is possible to adopt various schemes for address discharge and accordingly enhance the reliability of addressing.

In particular, in a plasma display panel using a discharge gas with a Xenon (Xe) partial pressure ratio of 10% or more, instability of address discharge due to the reduction of priming particles of plasma after the reset period is more serious. According to the present invention, address instability of such a plasma display panel using the discharge gas with the high xenon partial pressure rate can be removed, thus achieving a high picture-quality display panel.

While the present invention has been particularly illustrated and described with reference to exemplary embodiments thereof, it will be understood by those of ordinary skill in the art that various changes in form and details may be made therein without departing from the spirit and scope of the present invention as defined by the following claims.

What is claimed is:

1. A method of driving a display panel, comprising:

providing a display panel driven by driving waveforms consisting of a reset period, an address period and a sustain discharge period;

applying sequentially scanning pulses to a plurality of first electrodes during the address period, applying a bias voltage to second electrodes, and applying address data to address electrodes;

reducing an upper voltage of the scanning pulses over time while maintaining a potential between the upper voltage and a lower voltage of scanning pulses applied to the first electrodes constant during a predetermined time in the address period; and reducing a bias voltage applied to the second electrodes during a predetermined time in the address period.

2. The method of claim 1, a period during when the upper voltage of the scanning pulses is reduced coincides with a period when the bias voltage is reduced.

3. The method of claim 1, the bias voltage being reduced over a predetermined time in a period where the upper voltage of the scanning pulses is being reduced.

4. The method of claim 1, a reduction rate of the bias voltage being identical to a reduction rate of the upper voltage of the scanning pulses.

5. The method of claim 1, the bias voltage being reduced continuously.

6. The method of claim 1, the bias voltage being reduced step by step.

7. The method of claim 1, the upper voltage of the scanning pulses being reduced continuously.

8. The method of claim 1, the upper voltage of the scanning pulses being reduced step by step.

9. The method of claim 1, an upper voltage of the address data increasing over time during the address period.

10. The method of claim 1, widths of the scanning pulses being increased over time during the address period.

11. A program storage device readable by a machine, tangibly embodying a program of instructions executable by the machine to perform method steps of providing voltage waveforms to electrodes in a display panel during an address period, said method comprising:

providing the display panel driven by driving waveforms consisting of a reset period, the address period and a sustain discharge period;

applying sequentially scanning pulses to a plurality of first electrodes during the address period, applying a bias voltage to second electrodes, and applying address data to address electrodes;

reducing an upper voltage applied to the first electrodes over time while maintaining constant an amplitude of the scanning pulses applied to the first electrodes during a predetermined time in the address period; and reducing a bias voltage applied to the second electrodes over time during a predetermined time in the address period.

12. The program storage device of claim 11, a period during when the upper voltage of the scanning pulses is reduced coincides with a period when the bias voltage is reduced.

13. The program storage device of claim 11, the bias voltage being reduced gradually and continuously while the upper voltage of the scanning pulses being reduced in steps at discrete points in time.

14. A method, comprising:

providing a display panel having address electrodes, bias electrodes and scanning electrodes, each being supplied driving waveforms consisting of a reset period, an address period, and a sustain discharge period;

applying a first waveform to the scanning electrodes during the address period, the first waveform comprising a plurality of pulses, each having about the same amplitude, a voltage of the first waveform falling during the address period;

applying a second waveform to the bias electrodes during the address period, a voltage of the second waveform also falling during the address period; and applying address data to the address electrodes during the address period, the address data comprising a plurality of pulses that coincide respectively with the plurality of pulses in the first waveform applied to the scanning electrodes.

15. The method of claim 14, a rate of falling for the second waveform being the same as a rate of falling for the first waveform.

16. The method of claim 14, the voltage of the first waveform falling in steps only at discrete times and the voltage of the second waveform falling gradually and continuously.

17. The method of claim 14, the voltage of the first waveform falling for only a portion of the address period.

18. The method of claim 14, the display comprising a discharge gas that has a XE partial pressure of at least 10%.

19. The method of claim 14, the display being a high definition plasma display panel.

* * * * *